US008028447B2

(12) United States Patent
Dunham

(10) Patent No.: US 8,028,447 B2
(45) Date of Patent: Oct. 4, 2011

(54) DECORATIVE BLOCKS

(75) Inventor: Ann Holford Dunham, Dayton, OH (US)

(73) Assignee: Ann Holford Dunham, Dayton, OH (US)

( * ) Notice: Subject to any disclaimer, the term of this patent is extended or adjusted under 35 U.S.C. 154(b) by 71 days.

(21) Appl. No.: 12/049,354

(22) Filed: Mar. 16, 2008

(65) Prior Publication Data

US 2008/0229674 A1 Sep. 25, 2008

Related U.S. Application Data

(60) Provisional application No. 60/896,245, filed on Mar. 21, 2007.

(51) Int. Cl.
*G09F 13/00* (2006.01)

(52) U.S. Cl. ..... 40/431; 40/442; 52/311.1

(58) Field of Classification Search ..... 40/431, 40/473, 430, 494, 602, 440, 422, 412; 223/105; 52/306, 307, 311.1
See application file for complete search history.

(56) References Cited

U.S. PATENT DOCUMENTS

| | | | | |
|---|---|---|---|---|
| 2,947,584 | A * | 8/1960 | Harris | 40/610 |
| 3,270,451 | A * | 9/1966 | Bartleson et al. | 40/563 |
| 3,488,880 | A * | 1/1970 | Taylor | 446/85 |
| 4,400,162 | A * | 8/1983 | Rustemis | 434/291 |
| 4,441,679 | A * | 4/1984 | Calet | 248/156 |
| 4,490,932 | A * | 1/1985 | McIntire | 40/473 |
| 5,196,961 | A * | 3/1993 | Sun | 359/522 |
| 5,506,010 | A * | 4/1996 | Buck et al. | 428/14 |
| 6,088,973 | A * | 7/2000 | Weiss | 52/105 |
| 6,178,673 | B1 * | 1/2001 | Blackford et al. | 40/440 |
| 6,976,765 | B2 * | 12/2005 | Helenowski | 362/147 |

FOREIGN PATENT DOCUMENTS

GB 2237136 A * 4/1991

* cited by examiner

*Primary Examiner* — Joanne Silbermann
*Assistant Examiner* — Kristina Staley
(74) *Attorney, Agent, or Firm* — Ann H Dunham

(57) ABSTRACT

According to one embodiment, a decorative block comprising an open celled constructing block and a support rod suspending one or more ornaments such as art, logos and/or other decorative images or designs as part of a wall is provided.

20 Claims, 8 Drawing Sheets

DECORATIVE BLOCKS

CROSS-REFERENCE TO RELATED APPLICATIONS

This application claims priority to U.S. provisional Patent Application No. 60/896,245 entitled "Decorative Blocks" and filed on Mar. 21, 2007, the entire contents of which are hereby incorporated by reference herein in their entirety for all purposes.

STATEMENT REGARDING FEDERALLY SPONSORED RESEARCH OR DEVELOPMENT

Not Applicable

FIELD OF THE INVENTION

This disclosure relates to construction blocks. More particularly, example embodiments are directed to decorative construction blocks for displaying variable ornaments and other decorations.

BACKGROUND OF THE INVENTION

Blocks of various shapes, sizes and materials are commonly used in a variety of construction applications. Such blocks include pre-cast concrete blocks used in the construction of, inter alia, building foundations, interior walls, exterior walls, retaining walls, and the like, and pre-formed glass blocks used to construct, inter alia, partially opaque windows, walls, and the like.

In addition to providing structural support, such blocks may be used in applications where the finished structure is desired to have some degree of aesthetic character and/or decorative appeal. While current construction blocks may be pre-cast and/or pre-formed with decorative features or other ornamentation, there is no provision for varying such pre-cast and/or pre-formed feature or ornamentation once the block is constructed. As such, there is a need for a block with decorative features and/or ornamentation which can be readily customized to the aesthetic and/or decorative needs of an end user while maintaining or enhancing the structural integrity of the block.

BRIEF SUMMARY OF THE INVENTION

According to one embodiment, a decorative block comprising an open celled construction block and a support rod suspending one or more ornaments such as art, logos and/or other decorative images or designs as part of a wall is provided.

DETAILED DESCRIPTION OF THE INVENTION

Figure 1:
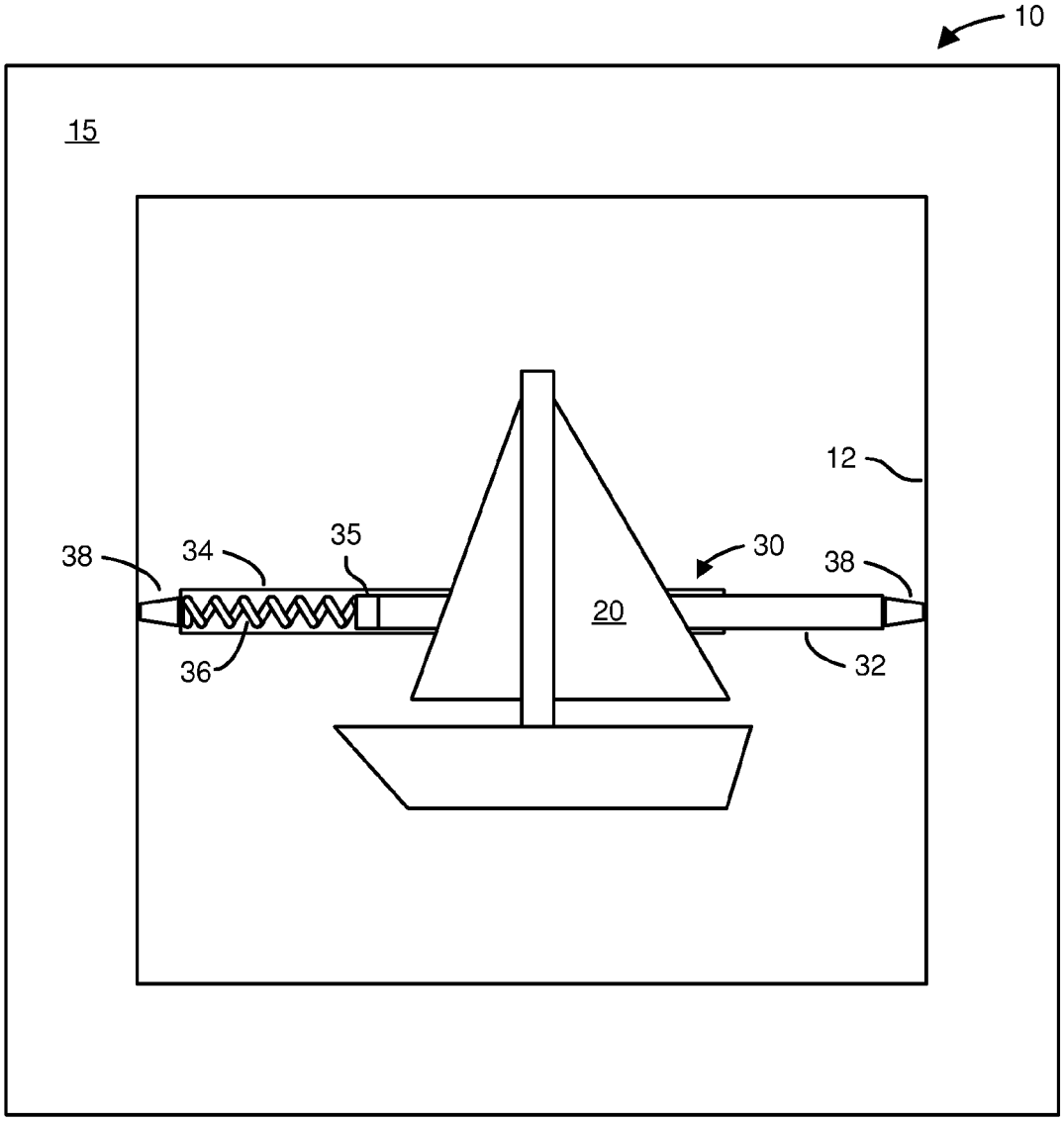
FIG. 1 illustrates a first embodiment of a decorative block.

FIG. 1 illustrates one embodiment of a decorative block 10. The decorative block 10 of FIG. 1 comprises a block 15 and an ornament 20 mounted on a support rod 30. The block 15 may comprise any material including, but not limited to wood, metal, glass, concrete, polymer, and mixtures/composites thereof, and may be designed for use in structural and/or decorative applications.

As shown in FIG. 1, a block 15 may comprise a square cross-section, being, for example, representative of a regular hexahedron or cube in three-dimensions (e.g., a polyhedron having six square faces), although a cross-section of a block 15 may comprise other shapes such as triangles, circles, ovals, stars, diamonds, rectangles, and the like. Likewise, a block 15 may be open, closed, or partially open in form. For example, where provided in the form of a cube, a block 15 may comprise an open-celled block (e.g., having four wall faces and two open ends), a closed-celled block (e.g., having six wall faces), or a partially open-celled block (e.g., having five wall faces and one open end). It should be noted that other three-dimensional block shapes, including but not limited other platonic solids (e.g., a tetrahedron, an octahedron, a dodecahedron, and an icosahedron) or polyhedron, spheroids, and the like, are also possible.

An ornament 20 of a decorative block 10 may comprise a variety of materials including but not limited to wood, metal, glass, concrete, polymer, and mixtures/composites thereof. Additionally, while, as shown in FIG. 1, an ornament 20 may be provided in the shape of a sailboat, other ornament shapes, and sizes relative to the size of a block 15, are possible.

As further shown in FIG. 1, a support rod 30 may comprise an inner sleeve 32 slidably positioned within an outer sleeve 34. Such configuration allows the length of the support rod 30 to be varied, facilitating installation and removal of the ornament 20 in and from the block 15. In a preferred embodiment the inner and outer sleeves 32 and 34 comprise circular cylinders manufactured from one or more corrosion resistant materials such as stainless steel, aluminum, polymer, and the like, although other materials and/or shapes, including box and/or channel members, are also possible.

As also shown in the embodiment of FIG. 1, the support rod 30 may further comprise one or more rod tips 38 situated on, for example, distal ends of the inner and outer sleeves 32 and 34. One or both of the rod tips 38 may be designed such that their cross-sectional area decreases in an axial direction moving away from the longitudinal center of the support rod 30. Such decreasing cross-sectional area increases the pressure (force per unit area) exerted against an inner surface 12 of the block 15 by the rod tips 38 for holding the ornament 20 in place. In alternate embodiments, one or both of the rod tips 38 may have a uniform cross-section comprising, for example, a circle, a square, a rectangle, an oval and the like, which cross section may be larger, smaller or consistent in size and/or shape with that of the inner and outer sleeves 32 and 34. Likewise, in further embodiments, the cross-section of the rod tips 38 may increase in an axial direction moving away from the longitudinal center of the support rod 30 through, for example, employment of a reverse taper, or enlarged nail-head type end, on one or both of the rod tips 38. It should be noted that one or both of the rod tips 38 may comprise separate components affixed to the support rod 30, or may be integrally formed with the support rod and/or the respective inner and outer sleeves 32 and 34.

As additionally illustrated in FIG. 1, a support rod 30 usable with a block 15 as part of a decorative block 10 may further comprise one or more elastic or resilient members such as a coil spring 36. In the embodiment of FIG. 1, the coil spring 36, which may further comprise one or more corrosion resistant materials such as stainless steel, aluminum, polymer, and the like, is positioned inside an outer sleeve 34 of the support rod 30 between an inside surface of a tip 38 associated with the outer sleeve 34 and an adjacent surface of an interior end 35 of the inner sleeve 34, although other spring designs, locations and/or orientations are possible.

Where an ornament 20 and support rod 30 are installed in a block 15 comprising a decorative block 10 as illustrated in the embodiment of FIG. 1, the spring 36 may be compressed against an inner surface of the tip 38 of the outer sleeve 34 and an adjacent surface of the interior end 35 of the inner sleeve 32. In such case, the spring 36 may exert a force down the length and through the respective tips 38 of the inner and outer sleeves 32 and 34 of the support rod 30, which force may further be transmitted by the rod tips 38 against respective portions of the inside surface 12 of the decorative block 10 to hold the rod 30 and associated ornament 20 in place.

When a coil spring 36 is included, its properties, including its length, coil diameter, wire size/thickness, material(s) of construction, and the like, may be varied to control the spring constant/provided force, and therefore the support capacity of the rod 30. In alternate embodiments, varying types of elastic or resilient members or materials may be used in place of a coil spring 36, such as one or more elastic bands, rods and the like. Similarly, in place or in concert with a spring 36, some or all of a support rod 30, including some or all of an inner and/or outer sleeve 32 and 34, may comprise one or more elastomeric or resilient materials such as natural and/or artificial rubber (e.g., butyl rubber, nitrile rubber, neoprene, and the like), to assist in installation and removal of the support rod 30 and associated ornament 20, and/or further augment the applied force (e.g., via compression of the elastomeric or resilient material) for holding the support rod 30 and associated ornament 20 in the block 15.

Figure 2:
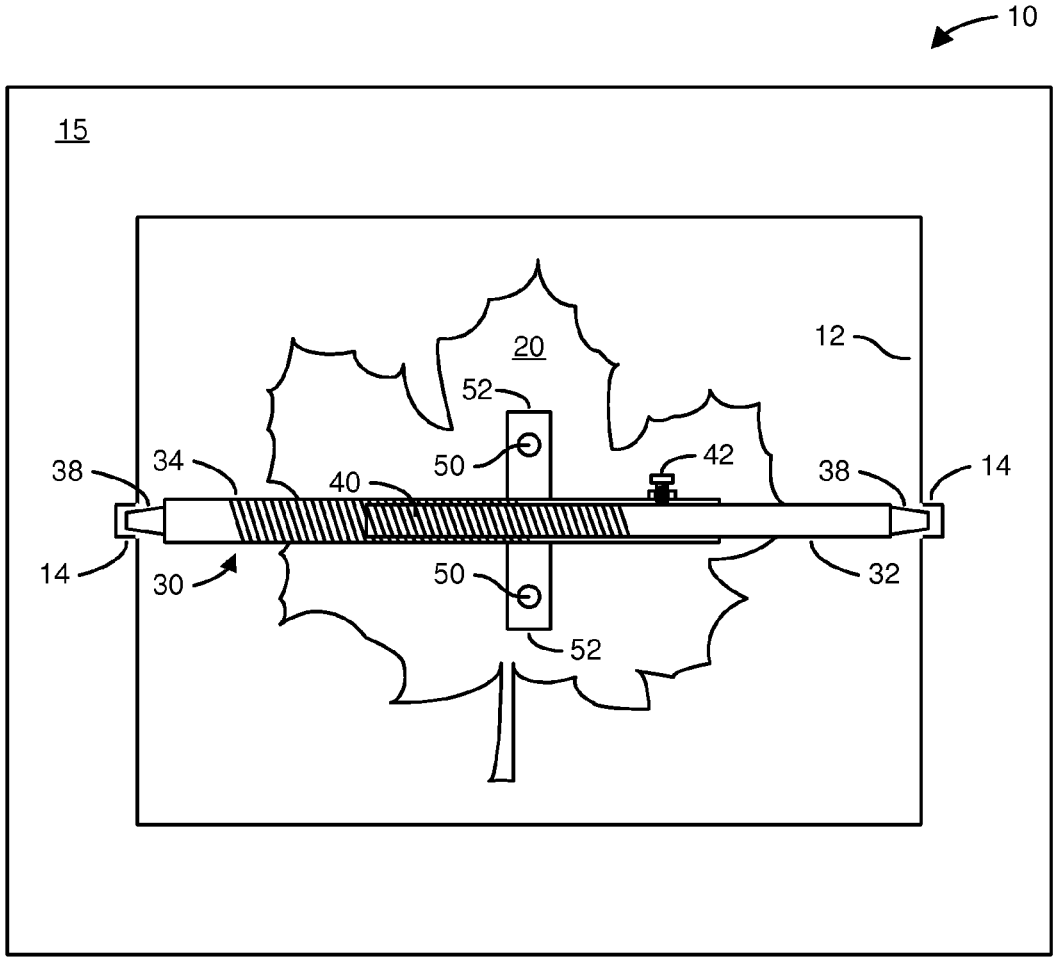
FIG. 2 illustrates a second embodiment of a decorative block.

FIG. 2 illustrates a second embodiment of a decorative block 10. The decorative block 10 of FIG. 2 comprises a block 15, a support rod 30 and an associated ornament 20. In the embodiment of FIG. 2, the ornament 20 is in the shape of a leaf, although alternate shapes and/or designs are possible.

Like the embodiment of FIG. 1, the support rod 30 of FIG. 2 comprises an inner sleeve 32 positioned inside an outer sleeve 34. In a preferred embodiment, the inner sleeve 32 and the outer sleeve 34 comprise circular cylinders manufactured from one or more corrosion resistant materials such as stainless steel, aluminum, polymer, and the like, although other materials and/or shapes, including box and/or channel members, are also possible.

In the embodiment illustrated in FIG. 2, the inner sleeve 32 of the support rod 30 interlocks with the outer sleeve 34 via a series of mating threads 40 located on an outside surface of the inner sleeve 32 and an inside surface of the outer sleeve 34. The mating threads 40 may span the length of the respective surfaces of the inner and/or outer sleeves 32 and 34, or only portion thereof (as shown). Use of the mating threads 40 allows the length of the support rod 30 to be varied by rotating the inner sleeve 32 with respect to the outer sleeve 34, to accommodate installation of the support rod 30 in varying size blocks 15, and/or in various locations of a given block 15, while providing for simplified installation and removal of the support rod 30. Likewise, adjustment of the length of the support rod 30 through use of the mating threads 40 provides means to compress the inner and outer sleeves 32 and 34, and/or their respective rod tips 38, against a portion of the inside surface 12 of the block 15 for support of a rod 30 and ornament 20 combination. Once set in place and/or properly tensioned, one or more fasteners, locks or clamps, such as one or more setscrews 42, may also be provided to fix the length of the support rod 30. It should be noted that one or more rod locking means, such as one or more set screws 42, may also be used to fix the length of the support rod 30 in alternate embodiments such as the embodiment of FIG. 1.

As further shown in the embodiment of FIG. 2, one or more sockets 14 may be provide on an inside surface 12 of a block 15 for locating and/or supporting a rod 30 and ornament 20 combination. Where provided, the one or more sockets 14 may positively engage one or more of the inner and outer sleeves 32 and 34, and/or an associated rod tip 38 in a respective socket 14. One or more sockets 14 may be used to facilitate placement and/or support of a support rod 30 and ornament 20 combination whether the support rod 30 is of, inter alia, a fixed, slidably variable length (e.g., support rod 30 of FIG. 1), rotationally variable length (e.g., support rod 30 of FIG. 2) or other (e.g., flexible resilient) design. Likewise, in some embodiments, multiple sockets 14 may be provided to accommodate more than one pre-set support rod 30 installation locations and/or installation of more than one support rod 30, as well as support installation of variable size and/or shape ornaments 20, and the like. It should be noted that while sockets 14 are illustrated with regard to the embodiment of FIG. 12, they are equally applicable to other embodiments such as, but not limited to, that previously shown in regard to FIG. 1.

As further illustrated in FIG. 2, a socket 14 may comprise one or more surfaces that are substantially perpendicular to a respective (adjacent) portion of an inner surface 12 of the block 15, although alternate designs, including designs comprising positively and/or negatively tapered surfaces designed to, for example, conform to a taper or other shape of a respective rod end 38, are also possible. In one such embodiment, a socket 14 may be provided to accept a rod end 38 having a reverse taper (e.g., a taper where the tip cross-sectional area increases in an axial direction away from the longitudinal center of the rod 30) for positively holding the respective end 38 of the rod 30 in place. Depending on their design and/or application, one or more sockets 14 for accepting the tips 38 of the rod 30 may be pre-formed during manufacture of the block 15, or may be drilled or otherwise formed at some point thereafter.

Irrespective of the design of the block 15, ornament 20 and/or support rod 30, an ornament 20 may be attached to a support rod 30 via one or more attachment means including, but not limited to, one or more fasteners, adhesives, welds, frictional elements, couplings, sleeves, bearings, and the like. Such attachment may be fixed or removable, and/or provide for one or more degrees of freedom of motion such as rotation parallel and/or perpendicular to the longitudinal axis of the support rod 30, and the like. Additionally, in some embodiments, an ornament 20 may be formed integrally with one or more portions of a support rod 30, such one or more of an inner or outer sleeve 32 and 34. In other embodiments, an ornament 20 may be attached to a support rod 30 through the use of one or more attachment means associated with the ornament 20 and/or support rod 30.

For example, as illustrated in FIG. 2, one or more brackets 52 may be provided to support an ornament 20 on a support rod 30 via use of one or more fasteners 50. Where provided, the one or more brackets 52 may be formed integrally with, or be otherwise fixably or removably attached to (e.g., via friction, adhesion, and/or through the use of one or more additional fasteners), a portion of the support rod 30, such as a portion of the outer sleeve 34, although alternate locations are possible. Likewise, where used, the one or more fasteners 50 used to attach the ornament 20 to the one or more brackets 52 may comprise one or more snaps, rivets, screws, welds, adhesives, and the like. Depending on the design, some or all of a relevant fastener 50, such as a screw stud (not shown) may be fixably or removably attached to the ornament 20. In one embodiment, a single bracket 52 formed integrally with a portion of the outer sleeve 34 of the support rod 30 is provided with a single fastener 50 comprising a thumb screw to allow ready change or replacement of an ornament 20 supported thereon.

Figure 3:
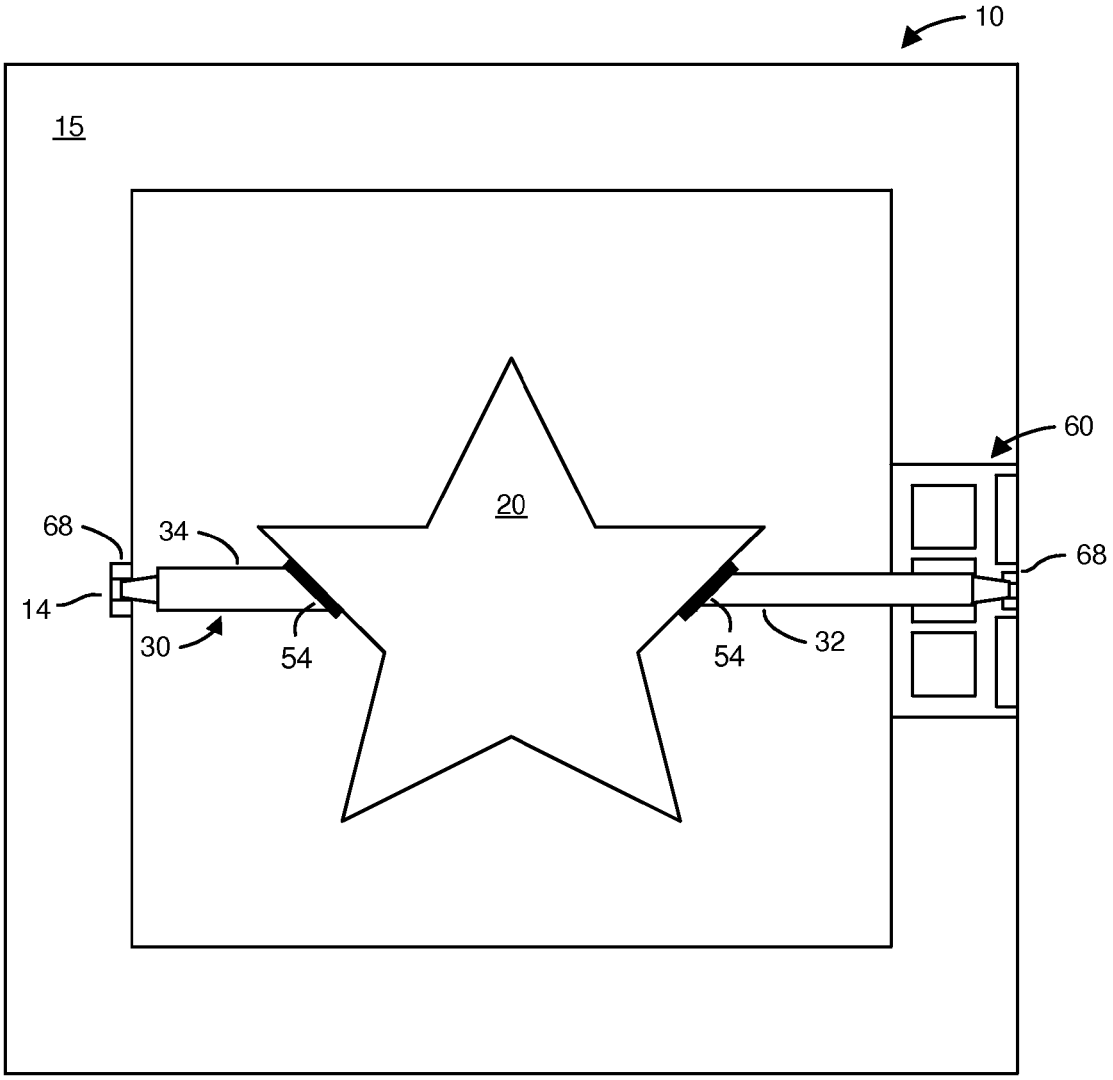
FIG. 3 illustrates a third embodiment of a decorative block.

In another embodiment, illustrated with respect to FIG. 3, a support rod 30 may pass through one or more suitable openings in an ornament 20 such as, for example, openings in respective sidewalls of two points of a hollow ornament 20 in the shape of a star, which ornament 20 may then be permanently or temporarily held in place on the support rod 30 through use of one or more supports or clamps comprising, for example, one or more flexible (e.g., rubber or polymer) o-rings or washers 54 press-fit around or otherwise fixably attached to the rod 30 at one or more locations at which the rod 30 passes through the ornament 20.

It should be noted that depending on the design of an ornament 20 and a support rod 30, including the design of any related fastener 50, bracket 52, and/or other support such as one or more o-rings or washers 54, an ornament 20 may be fixably attached to a support rod 30 such that it does not move independently of the rod 30. Alternately, an ornament 20 may be movably attached to a support rod 30 such that the ornament 20 may, for example, rotate about, or perpendicular to, the longitudinal axis of the support rod 30, independent of any motion or rotation of the rod 30. In some embodiments, one or more friction reducing elements and/or materials may be provided to facilitate the relative or concurrent motion of an ornament 20 with or with respect to a support rod 30. Such elements may comprise one or more ball, journal or other bearings or surfaces which may comprise in whole or in part one or more friction reducing materials such as, but not limited to, polytetrafluoroethylene (PTFE), and the like, and may be provided at one or more interface points of an ornament 20 and a support rod 30, and/or one or more contact points of the support rod 30 and a block 15, and the like.

For example, as shown in the embodiment of FIG. 3, one or more provided sockets 14 may comprise one or more bearings 68 for facilitating rotation of an ornament 20 in concert with an associated support rod 30, although alternate embodiments wherein, for example, one or more bearings 68 are provided at one or more contact points of an ornament 20 with an associated support rod 30 to facilitate rotation of the ornament 20 absent rotation of the rod 30, are also possible.

Rotation of an ornament 20, with or without an accompanying motion or rotation of an associated support rod 30, may occur due to natural or forced motion of air past the ornament 20 such as by, for example, atmospheric winds, local convection currents, HVAC system operation, and the like. Likewise, an ornament 20 may also rotate with, or with respect to, a support rod 30 by virtue of a drive system to provide for motion of the ornament 20 irrespective of any coincident, external air movement or other energy input. In one embodiment, an ornament 20 is designed to emit a whistle upon natural and/or forced rotation thereof, and/or upon external motion of air by or through the ornament 20.

As illustrated in FIG. 3, a drive system in the form of an electromechanical drive 60 may be associated with a block 15 to facilitate rotation of an ornament 20 through rotation of an associated support rod 30. However, in alternate embodiments, a drive system, such as an electromechanical drive 60, may be associated with, or otherwise coupled to, an ornament 20 to provide for motion of the ornament 20 independent of any motion of an associated support rod 30.

As previously described, an ornament 20 may be attached to a support rod 30 by, for example, one or more fasteners 50, which fasteners 50 may further be associated with one or more brackets 52. In the embodiment of FIG. 3, one or more fasteners 50 and/or brackets 52 (not shown) may be provided to fixably attach the ornament 20 to the support rod 30 such that the ornament 20 rotates in unison with support rod 30, although other support and/or rotation means, including frictional connections and/or press-fits of an ornament 20 on a support rod 30 through an associated opening of the ornament 20, are also possible. In other embodiments, a support rod 30 may be placed through a hollow region or other opening of an ornament 20 for independent motion of some or all of an ornament 20 with respect to a support rod 30.

Figure 4:
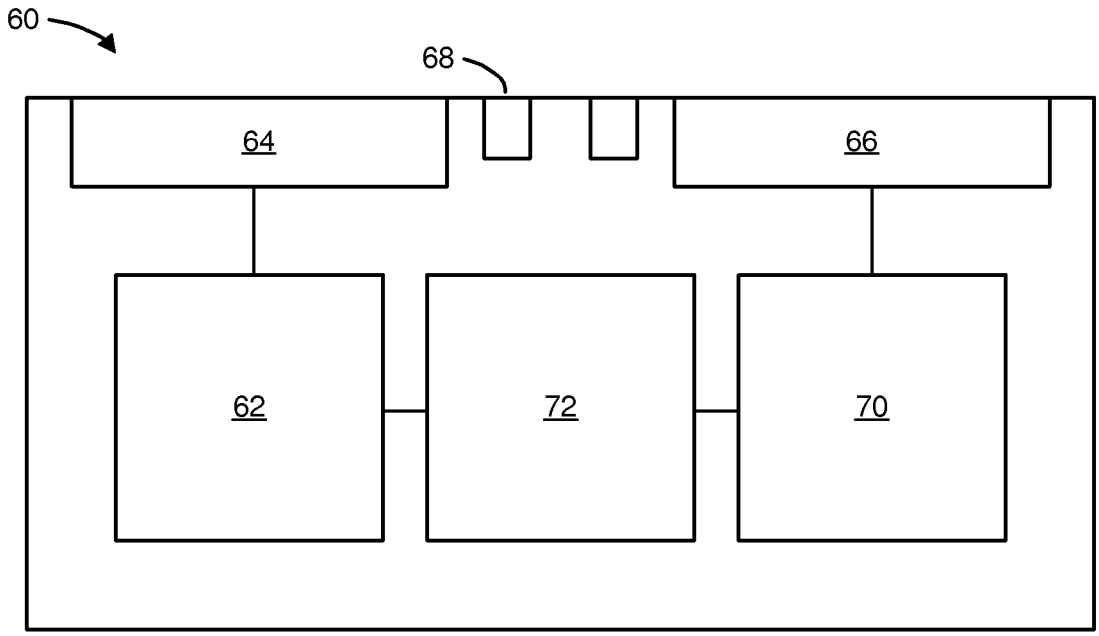
FIG. 4 illustrates an embodiment of a drive system to facilitate rotation of an ornament associated with a decorative block.

As illustrated in FIG. 4, a drive system, such as an electromechanical drive 60, may comprise one or more of a motor 62, a power supply 64, a controller 66, a bearing 68, a speed control mechanism 70, and/or a coupling 72. A power supply 64 may comprise a battery, a line (e.g., alternating and/or direct current) voltage source, a solar cell, combinations of the same, and the like. Likewise, a controller 66 may comprise an electromechanical switch, a photocell, a motion detector, combinations of the same, and the like, for manually and/or automatically actuating the electromechanical drive 60. A controller 66 may also comprise control electronics for, inter alia, varying a speed of rotation of an associated motor 62 by, for example, controlling a voltage supplied to the motor 62. Alternately or additionally, a speed control mechanism 70 comprising one or more speed control elements, such as one or more gears, pulleys, wheels and/or frictional elements, may be provided to control, alone or in combination with a controller 66, a speed of rotation provided by the electromechanical drive 60. Finally, a coupling 72 may be provided to couple a support rod 30 and/or an ornament 20 to a motor 62 and/or a speed control mechanism 70 for rotation.

Figure 8:
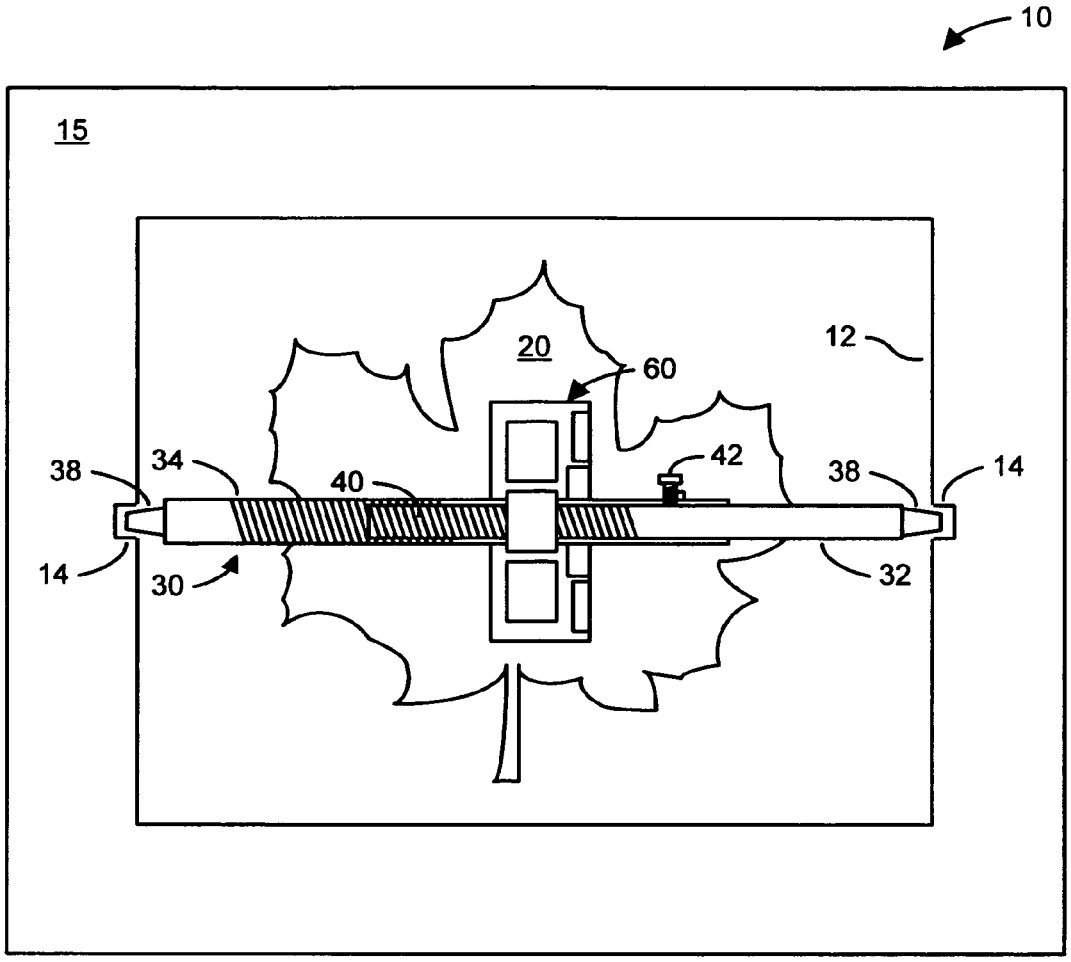
FIG. 8 illustrates an embodiment of a decorative block having a drive on a support rod.

In one embodiment, an electromechanical drive 60 may be provided wherein a motor 62 drives a support rod 30 coupled to a motor 62 by way of a speed control mechanism 70 through use of a coupling 72. Power for such motor may be provided for by a rechargeable battery/solar cell combination 64. Further, such motor may be selectably operated, such as on a nocturnal and/or diurnal cycle, by a controller 66. However, alternate designs and/or operations, such as provision of an electromechanical drive 60 on a support rod 30 for rotation of an ornament 20 independent of rotation of the support rod 30, as shown, for example, with respect to FIG. 8, are possible.

Figure 5:
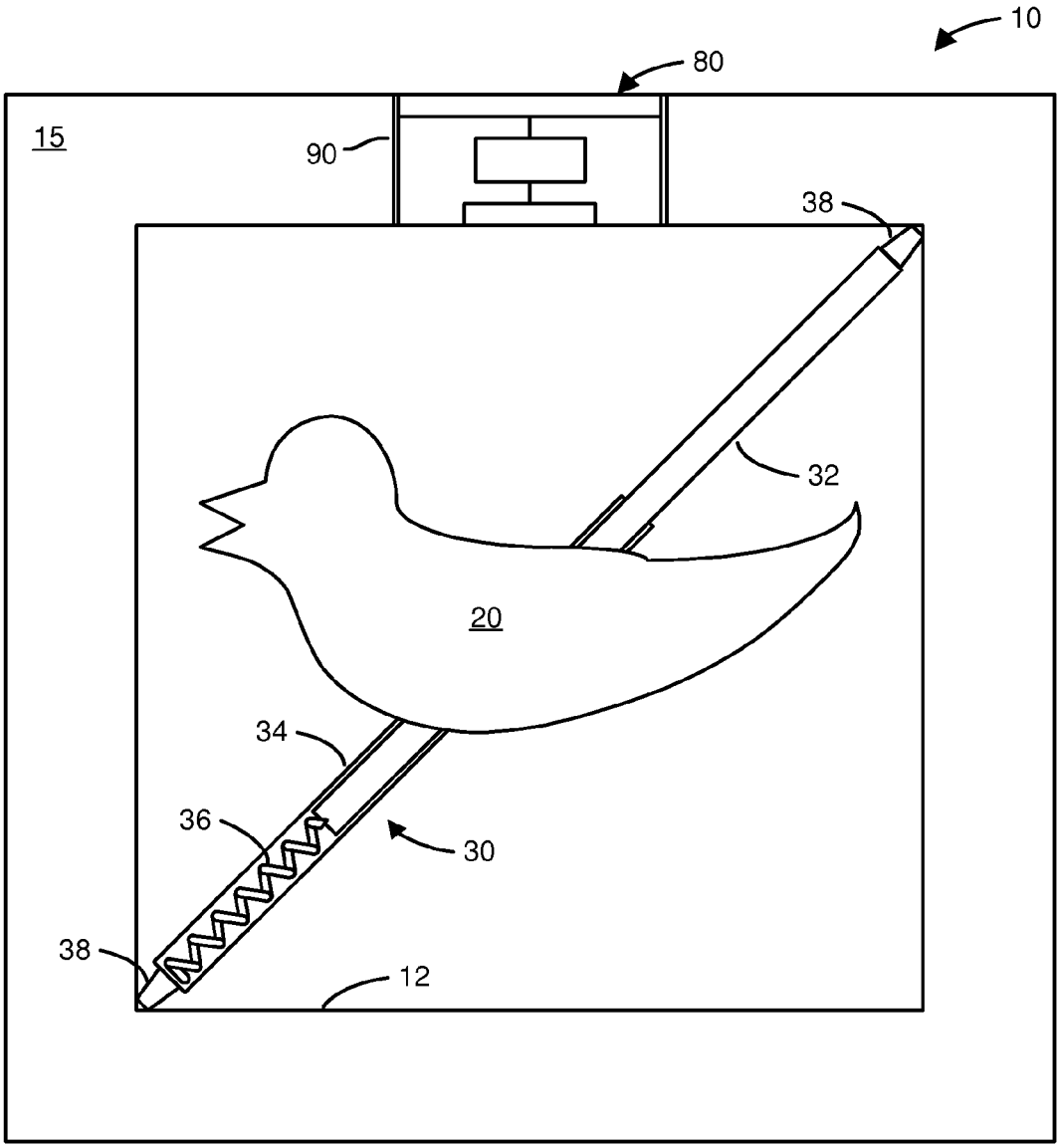
FIG. 5 illustrates a fourth embodiment of a decorative block.

As illustrated in FIG. 5, a decorative block 10 may further comprise a light source 80 for, for example, illuminating an ornament 20. As shown in FIG. 5, the light source 80 may be installed in a cutout 90 in one or more surfaces 12 of a block 15 of the decorative block 10. A cutout 90 is typically sized for placement of the light source 80, and may be round, square, rectangular, triangular, oblong and the like, as required or desired. Where provided, a cutout 90 may be pre-cast or pre-formed into a decorative block 10, or it may be cut, drilled, stamped or otherwise created after formation of a block 15. The cutout 90 may be a through hole (as shown), or a partial hole, traversing a portion of the thickness of a wall of the block 15, depending on, inter alia, functionality of and power supply for the light source 80.

Figure 6:
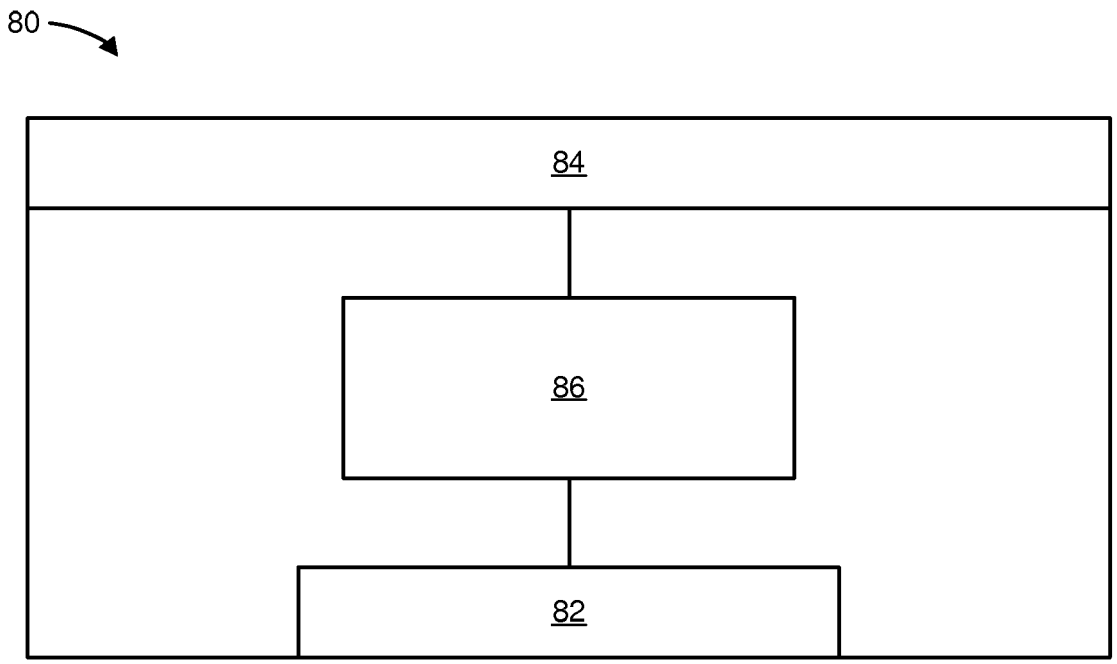
FIG. 6 illustrates an embodiment of a light to facilitate illumination of an ornament associated with a decorative block.

As shown in greater detail in FIG. 6, a light source 80 may comprise one or more of a lamp 82, a power supply 84, and a controller 86. Each lamp 82 may comprise one or more of an incandescent bulb, a fluorescent bulb, a light emitting diode (LED), and the like. A power supply 84 may comprise a battery, a line (e.g., alternating and/or direct current) voltage source, a solar cell, combinations of the same, and the like. Further, a controller 86 may comprise an electromechanical switch, a photocell, a motion detector, combinations of the same, and the like, for manually or automatically actuating one or more light sources 82. A controller 86 may also comprise control electronics for, inter alia, varying a time, duration, and/or intensity of illumination (e.g., greater intensity during the day and lesser intensity at night, or vice versa) of one or more lamps 82 by, for example, controlling a voltage supplied to each of the lamps 82. In one embodiment, a power supply 84 comprising a rechargeable battery/solar cell combination is electrically coupled to a controller 86 in the form or a daylight sensor (e.g., a photoelectric cell) for actuating and powering one or more LED's from, for example, dusk to dawn.

Figure 7:
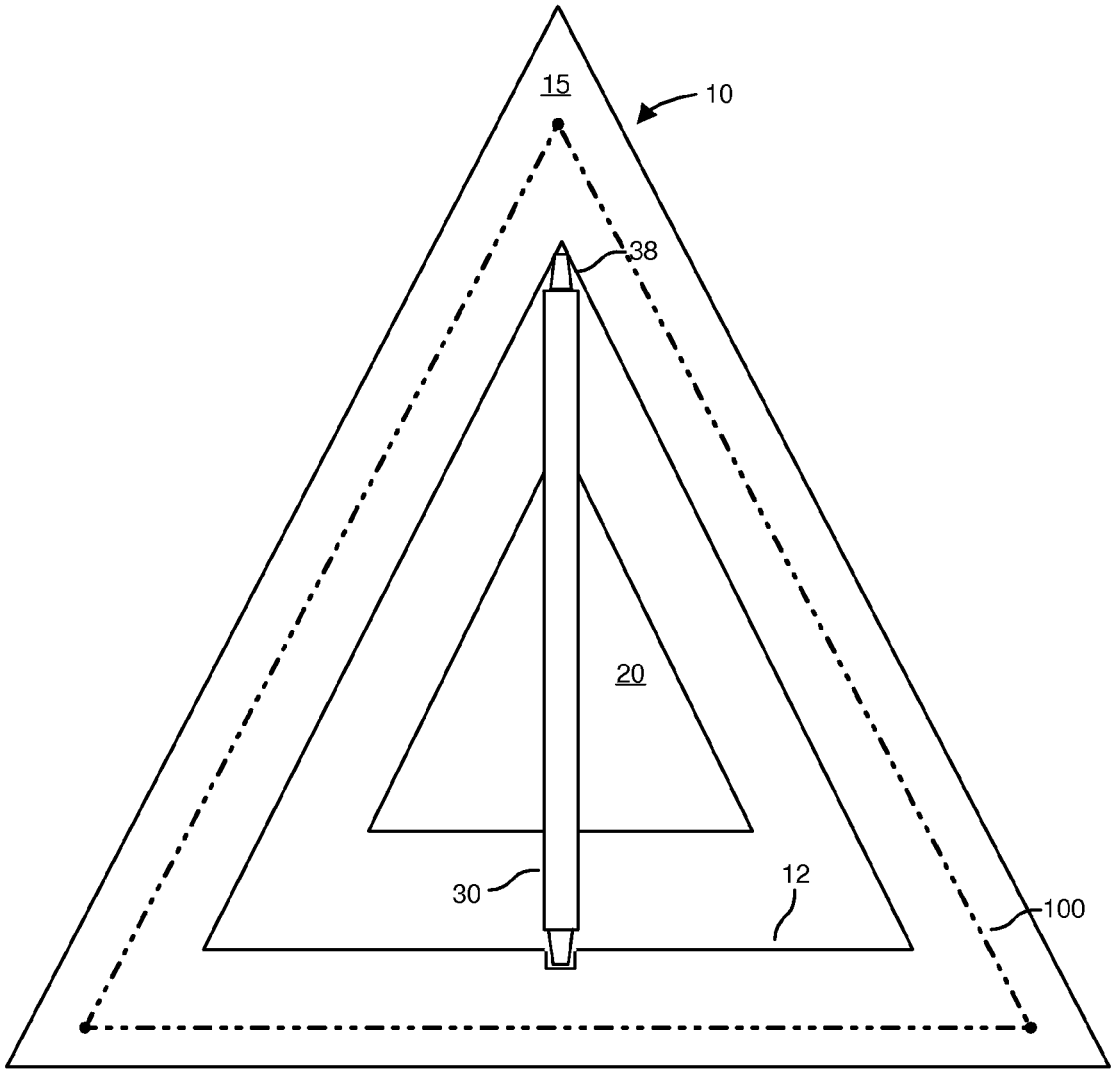
FIG. 7 illustrates a fifth embodiment of a decorative block.

In a further embodiment, illustrated in FIG. 7, a decorative block 10 may comprise a block 15, an ornament 20, and a support rod 30 including one or more rod tips 38. As further shown in FIG. 7, a block 15 of a decorative block 10 may also include one or more reinforcements 100. The one or more reinforcements 100 may be used to provide additional tensile and/or compressive strength to a block 15 of a decorative block 10. Such reinforcement may enhance use of a decorative block 10 in, for example, load-bearing applications. Where used, the one or more reinforcements 100 may comprise metal (e.g., steel, including stainless steel, aluminum, copper, and the like) and/or polymer reinforcing bars, rods, tubes, dowels, and the like, attached to, or formed integrally with, one or more walls of the block 15.

In various embodiments, an ornament 20 may be held in place through use of a plurality of support rods 30 respective ends or tips 38 of each of which may be in contact with the ornament 20 and, for example, an inner surface 12 of a block 15. Likewise, in other embodiments, more than one ornament 20 may be supported by a given support rod 30 and/or more than one ornament 20 and support rod 30 may be utilized in a given block 15.

The above description is illustrative, and not restrictive. Many other embodiments will be apparent to those of skill in the art upon reviewing the above description. The scope of the embodiments should therefore be determined with reference to the appended claims, along with the full scope of equivalents to which such claims are entitled.

In the foregoing description of the embodiments, various features are grouped together in a single embodiment for the purpose of simplifying disclosure. Likewise, and for a similar reason, various features are described with reference to one embodiment, but not another. This method of disclosure is not to be interpreted as reflecting that the claimed embodiments have more or less features than are expressly recited in each claim. Rather, as the following claims reflect, inventive subject matter lies in more (e.g., combinations) or less than all features of a single disclosed embodiment. Thus the following claims are hereby incorporated into the description of the embodiments, with each claim standing on its own as a separate exemplary embodiment.

It should be appreciated by those skilled in the art that the conception and specific embodiments disclosed herein might be readily utilized as a basis for modifying or designing other structures or materials for carrying out the purposes of the present invention. Thus, it should also be realized by those skilled in the art that such equivalent constructions or material combinations do not depart from the spirit and scope of the invention as set forth in the appended claims.

What is claimed is:

1. A decorative block for use with a fence or wall structure, the decorative block comprising:

a partially open-celled construction block having five wall faces and at least one open end for viewing an interior of the decorative block, the decorative block further comprising constructional reinforcements;

a support rod held between two of the five wall faces; and an ornament, and a drive system connected to said decorative block for rotating the ornament;

wherein the support rod supports the ornament within the partially open-celled construction block; and wherein the decorative block is able to be incorporated into a fence or wall structure for display.

2. The decorative block of claim 1, wherein the support rod comprises a first sleeve and a second sleeve, and wherein at least a first portion of the first sleeve is positioned within the second sleeve.

3. The decorative block of claim 2, wherein the support rod further comprises a resilient member adapted to force the first portion of the first sleeve out of the second sleeve.

4. The decorative block of claim 3, wherein the resilient member comprises a coil spring.

5. The decorative block of claim 2, wherein a portion of an outer surface of the first sleeve interlocks with a portion of an inner surface of the second sleeve via mating threads associated with the respective inner and outer sleeve portions.

6. The decorative block of claim 5, wherein a length of the support rod is adjustable along the respective inner and outer sleeve portions through rotation of the first sleeve with respect to the second sleeve.

7. The decorative block of claim 6, wherein the support rod further comprises locking means for fixing a length of the support rod.

8. The decorative block of claim 7, wherein the locking means comprise one or more setscrews.

9. The decorative block of claim 1, wherein the open-celled construction block includes one or more sockets adapted to accept an end of the support rod.

10. The decorative block of claim 1, further comprising attachment means for fixably attaching the ornament to the support rod.

11. The decorative block of claim 10, wherein the attachment means comprise one or more brackets.

12. The decorative block of claim 1, further comprising a drive system adapted to rotate the ornament.

13. The decorative block of claim 12, wherein the drive system is adapted to rotate the ornament independent of the support rod.

14. The decorative block of claim 12, wherein the drive system is adapted to rotate the ornament during nighttime hours.

15. The decorative block of claim 1, further comprising a light adapted to illuminate the ornament.

16. The decorative block of claim 15, wherein the light is adapted to illuminate the ornament during nighttime hours.

17. The decorative block of claim 1, further comprising:

a drive system adapted to rotate the ornament; and a light adapted to illuminate the ornament, wherein the drive system is adapted to rotate the ornament during daylight and nighttime hours, and the light is adapted to illuminate the ornament only during nighttime hours.

18. The decorative block of claim 17, wherein the drive system is further adapted to rotate the ornament independent of the support rod.

19. The decorative block of claim 15, wherein the light is adapted to illuminate the ornament at a first intensity during daytime hours and a second intensity, less than the first intensity, during nighttime hours.

20. The decorative block of claim 1, wherein the open-celled construction block further comprises one or more reinforcement rods adapted to increase tensile strength of the block.

* * * * *